US008128341B2

(12) United States Patent
Wieghardt

(10) Patent No.: US 8,128,341 B2
(45) Date of Patent: Mar. 6, 2012

(54) STEAM TURBINE

(75) Inventor: Kai Wieghardt, Mannheim (DE)

(73) Assignee: Siemens Aktiengesellschaft, Munich (DE)

( * ) Notice: Subject to any disclaimer, the term of this patent is extended or adjusted under 35 U.S.C. 154(b) by 638 days.

(21) Appl. No.: 12/084,300

(22) PCT Filed: Oct. 24, 2006

(86) PCT No.: PCT/EP2006/067717

§ 371 (c)(1),
(2), (4) Date: Apr. 7, 2009

(87) PCT Pub. No.: WO2007/051733

PCT Pub. Date: May 10, 2007

(65) Prior Publication Data

US 2009/0185895 A1 Jul. 23, 2009

(30) Foreign Application Priority Data

Oct. 31, 2005 (EP) ..... 05023760

(51) Int. Cl.
*F01D 3/02* (2006.01)
*F01D 3/04* (2006.01)

(52) U.S. Cl. ..... 415/106

(58) Field of Classification Search ..... 415/106
See application file for complete search history.

(56) References Cited

U.S. PATENT DOCUMENTS

| | | | | |
|---|---|---|---|---|
| 4,170,435 | A * | 10/1979 | Swearingen | 415/1 |
| 5,061,151 | A * | 10/1991 | Steiger | 415/106 |
| 5,540,546 | A * | 7/1996 | Bouricet | 415/104 |
| 6,048,169 | A | 4/2000 | Feldmüller et al. | |
| 6,082,962 | A | 7/2000 | Drosdziok et al. | |
| 6,129,507 | A * | 10/2000 | Ganelin | 415/1 |
| 6,193,462 | B1 * | 2/2001 | Kubota | 415/106 |
| 6,655,910 | B2 * | 12/2003 | Fonda-Bonardi | 415/106 |
| 2003/0133785 | A1 * | 7/2003 | Fonda-Bonardi | 415/106 |
| 2005/0118025 | A1 | 6/2005 | Hiegemann et al. | |

FOREIGN PATENT DOCUMENTS

| | | | |
|---|---|---|---|
| CN | 1370254 | A | 9/2002 |
| EP | 991850 | B1 | 4/2000 |
| EP | 1154123 | A1 | 11/2001 |
| EP | 1624155 | A1 | 2/2006 |
| EP | 1945911 | B1 | 7/2008 |

* cited by examiner

*Primary Examiner* — George Fourson, III

(57) ABSTRACT

Disclosed is a steam turbine with a casing, wherein a turbine shaft having a thrust-compensating piston is rotatably mounted inside the casing and directed along a rotation axis, wherein a flow passage is formed between the casing and the turbine shaft. The turbine shaft has in its interior a cooling line for directing cooling steam in the direction of the rotation axis. The cooling line, on one end, is connected to at least one inflow line for the inflow of cooling steam into the cooling line from the flow passage, and on the other end, is connected to an outflow line for directing cooling steam onto a lateral surface of the thrust-compensating piston. An essential aspect is, the cooling steam discharging onto the lateral surface of the thrust-compensating piston mixes with some of the live steam and is directed back into the flow passage via a return line arranged in the casing.

14 Claims, 7 Drawing Sheets

STEAM TURBINE

CROSS REFERENCE TO RELATED APPLICATIONS

This application is the US National Stage of International Application No. PCT/EP2006/067717, filed Oct. 24, 2006 and claims the benefit thereof. The International Application claims the benefits of European application No. 05023760.1 filed Oct. 31, 2005, both of the applications are incorporated by reference herein in their entirety.

FIELD OF INVENTION

The invention relates to a steam turbine with a casing, wherein a turbine shaft, which has a thrust compensating piston, is arranged in a rotatably mounted manner inside the casing and is oriented along a rotational axis, wherein a flow passage is formed between the casing and the turbine shaft, wherein the turbine shaft has a cooling line within it for guiding cooling steam in the direction of the rotational axis, and the cooling line is connected to at least one inflow line for inflow of cooling steam from the flow passage into the cooling line.

BACKGROUND OF THE INVENTION

The use of steam at higher pressures and temperatures contributes to the increase of efficiency of a steam turbine. The use of steam with such a steam condition makes increased demands on the corresponding steam turbine.

Each turbine, or turbine section, which is exposed to through-flow of a working medium in the form of steam, is understood by a steam turbine in the meaning of the present application. In contrast to this, gas turbines are exposed to throughflow by gas and/or air as working medium, which, however, are subjected to entirely different temperature and pressure conditions than the steam in the case of a steam turbine. Unlike gas turbines, for example the working medium which flows to a turbine section in the case of steam turbines has the highest pressure simultaneously with the highest temperature. An open cooling system, as in the case of gas turbines, cannot be realized, therefore, without external feed.

A steam turbine customarily comprises a rotatably mounted rotor which is populated with blades and arranged inside a casing shell. When the flow space, which is formed by the casing shell, is exposed to throughflow with heated and pressurized steam, the rotor, via the blades, is set in rotation by means of the steam. The blades which are attached on the rotor are also referred to as rotor blades. Furthermore, stationary stator blades, which engage in the interspaces of the rotor blades, are customarily attached on the casing shell. A stator blade is customarily mounted at a first point along an inner side of the steam turbine casing. In this case, it is customarily part of a stator blade ring which comprises a number of stator blades which are arranged along an inner circumference on the inner side of the steam turbine casing. In this case, each stator blade points radially inwards with its blade airfoil. A stator blade ring at a point along the axial extent is also referred to as a stator blade row. A number of stator blade rows are customarily arranged one behind the other.

Cooling plays an essential role when increasing the efficiency. With the previously known cooling medium methods for cooling a steam turbine casing, a distinction is to be made between active cooling and passive cooling. With active cooling, cooling is brought about by means of a cooling medium which is fed separately to the steam turbine casing, i.e. in addition to the working medium. In contrast, passive cooling is carried out simply by means of suitable guiding or use of the working medium. Customary cooling of a steam turbine casing is limited to passive cooling. Therefore, it is known for example to flow-wash an inner casing of a steam turbine with cool, already expanded steam. However, this has the disadvantage that a temperature difference over the inner casing wall must remain limited, since otherwise with a temperature difference which is too great the inner casing would thermally deform too much. During flow-washing of the inner casing, heat dissipation certainly takes place, but the heat dissipation takes place relatively far away from the point of heat input. Heat dissipation in direct proximity to the heat input has not previously been put into effect in sufficient measure. A further passive cooling can be achieved by means of a suitable design of the expansion of the working medium in a so-called diagonal stage.

By this, however, only a very limited cooling effect upon the casing can be achieved.

The steam turbine shafts, which are rotatably mounted in the steam turbines, are thermally highly stressed during operation. The development and production of a steam turbine shaft is at the same time expensive and time-consuming. The steam turbine shafts are considered as the most highly stressed and most expensive components of a steam turbine. This applies more and more to high steam temperatures.

Sometimes, on account of the high masses of the steam turbine shafts, these are thermally sluggish which has a negative effect during a thermal load changing of a turbine-generator set. That means that the reaction of the entire steam turbine to a load change depends in a high degree upon the speed of the steam turbine shaft being able to react to thermally changed conditions. For monitoring the steam turbine shaft, as standard the temperature is monitored, which is time-consuming and costly.

One characteristic of steam turbine shafts is that these do not have an essential heat sink. Therefore, cooling of the rotor blades, which are arranged on the steam turbine shaft, proves to be difficult.

For improving the adaptation of a steam turbine shaft to a thermal stress, it is known to form this hollow in the inlet region, or to form this as a hollow shaft. These cavities as a rule are closed off and filled with air.

However, the high stresses which occur during operation, which for the most part consist of tangential stresses from the centrifugal force, act disadvantageously upon the aforementioned steam turbine hollow shafts. These stresses are about twice as high as the stresses which would occur in the case of corresponding solid shafts. This has a strong influence upon the material selection of the hollow shafts, which can lead to the hollow shafts not being suitable, or not realizable, for high steam conditions.

In gas turbine construction, it is known to construct air-cooled hollow shafts as thin-walled welded constructions. It is known inter alia to form the gas turbine shafts with disks via so-called Hirth toothing. These gas turbine shafts have a central tie-bolt for this.

However, a direct transfer of the cooling principles in gas turbines to steam turbine construction as a rule is not possible, since a steam turbine, unlike the gas turbine, is operated as a closed system. By this, it is to be understood that the working medium is located in a circuit and is not discharged into the environment. The working medium which is used in a gas turbine, which consists essentially of air and exhaust gas, is discharged into the environment after passage through the turbine unit of the gas turbine.

Steam turbines, furthermore, unlike the gas turbine, do not have a compressor unit, and, moreover, the shafts of the steam turbine are generally only radially accessible.

Steam turbines with a steam inlet temperature of approximately 600° C. were developed and constructed in the 1950s. These steam turbines have radial blading. Today's prior art in steam turbine construction comprises shaft cooling systems with a radial arrangement of the first stator blade row in the form of diagonal or governing stages. With this embodiment, however, the low cooling action of these diagonal or governing stages is disadvantageous.

In the steam turbine shafts, the piston region and inlet region are particularly thermally loaded. The region of a thrust-compensating piston is to be understood by piston region. The thrust-compensating piston acts in a steam turbine in such a way that with a force, which is created by the working medium, upon the shaft in one direction, an opposing force is developed in the opposite direction.

Cooling of a steam turbine shaft is described inter alia in EP 0 991 850 B1. In this case, a compact or high-pressure and intermediate-pressure turbine section is constructed by means of a connection in the shaft, through which a cooling medium can flow. With this, it is considered disadvantageous that a controllable bypass cannot be formed between two different expansion sections. Furthermore, problems during variable load operation are possible.

It would be desirable to form a steam turbine which is suitable for high temperatures.

SUMMARY OF INVENTION

It is the object of the invention, therefore, to disclose a steam turbine which can be operated at high steam temperatures.

This object is achieved by means of a steam turbine with a casing, wherein a turbine shaft, which has a thrust-compensating piston, is arranged in a rotatably mounted manner inside the casing and is oriented along a rotational axis, wherein a flow passage is formed between the casing and the turbine shaft, wherein the turbine shaft has a cooling line within it for guiding cooling steam in the direction of the rotational axis, and the cooling line is connected on one side to at least one inflow line for inflow of cooling steam from the flow passage into the cooling line, wherein the cooling line is connected on the other side to at least outflow line for guiding cooling steam onto a generated surface of the thrust-compensating piston.

In an advantageous development, the steam turbine is formed with a return line for return of mixed steam, which is formed from the cooling steam and compensating piston leakage steam, wherein the return leads into the flow passage.

Therefore, a steam turbine with a steam turbine shaft is proposed which is hollow in the hot regions in each case during operation, and which is provided with internal cooling. The invention is based upon the aspect that during operation expanded steam is guided through the inside of the shaft to the compensating piston and cools the thermally highly stressed compensating piston there. With the proposed cooling capability, particularly those steam turbine shafts which have a compensating piston can be cooled. These would be for example high-pressure, intermediate-pressure and also K-turbine sections, wherein a compact-turbine section which has a high-pressure and intermediate-pressure turbine section located on one steam turbine shaft is to be understood by a K-turbine section. The advantage of the invention inter alia is to be seen in the steam turbine shaft being able to be formed with creep stability on the one hand, and flexibly reacting to thermal loads on the other hand. During a load change for example, during which a higher thermal load can occur, the cooling leads to the thermal load of the shaft ultimately reducing. This especially applies to the regions which are particularly thermally loaded, such as the inlet region or the compensating piston.

In this case, the invention starts from the aspect that the cooling steam is mixed with compensating piston leakage steam, and this mixed steam which is formed is fed again to the flow passage in order to perform further work there. The efficiency of the steam turbine increases as a result.

Consequently, a quick starting of the steam turbine is possible, which for this day and age represents a particular aspect wherein the point is to quickly make power available. Furthermore, an advantage is created by means of the steam turbine according to the invention by the fact that the costs for a shaft monitoring can be lower. A hollow steam turbine shaft has a lower mass compared with a solid shaft and consequently also has a lower thermal capacity compared with a solid shaft, and also has a larger flow-washed surface. As result of this, quick warming-up of the steam turbine shaft is possible.

A further aspect of the invention is that the creep rupture strength of the material which is used for the steam turbine shaft is increased as result of the improved cooling. The creep rupture strength in this case can be increased by a factor greater than 2 compared with a solid shaft, so that the stress increase, which is described above, is overcompensated. This leads to a widening of the range of application of the steam turbine shaft.

A further aspect of the invention is that the radial clearances can be reduced by the diameter of the hollow shaft being enlarged as a result of radial centrifugal forces. The radial centrifugal force is proportional to the square of the speed. An increase of speed consequently brings about a reduction of radial clearances, which leads to an increase of the overall efficiency of the steam turbine.

A further aspect of the invention is that hollow shafts can be inexpensively produced.

In an advantageous development, the casing comprises an inner casing and an outer casing. High-pressure turbine sections as well as intermediate-pressure and compact-turbine sections are parts of steam turbines which can be thermally extremely highly loaded. As a rule, high-pressure, intermediate-pressure and also compact-turbine sections are formed with an inner casing, upon which stator blades are arranged, and with an outer casing which is arranged around the inner casing.

In an advantageous development, the turbine shaft in the axial direction has at least two sections consisting of different materials.

Consequently, costs can be saved. As a rule, high-grade material is used in the thermally loaded regions.

For example, 10% chromium steel can be used in the thermally loaded regions, whereas 1% chromium steel can be used in the regions of lower thermal loading.

The turbine shaft in the axial direction expediently has three sections consisting of different materials. The two outer sections especially consist of the same material. Consequently, suitable material can be purposefully selected for the respective section of the steam turbine shaft of variable thermal loading.

The sections which consist of different materials are advantageously welded to each other. As a result of the welding, a stable turbine shaft is formed.

In a further advantageous alternative embodiment, the sections which consist of different materials are interconnected by a means of a Hirth toothing. The essential advantage of the Hirth toothing is the especially high thermal flexibility of the turbine shaft. A further advantage is that as a rule this leads to the turbine shaft being able to be quickly manufactured. Furthermore, the turbine shaft can be formed inexpensively.

In a further advantageous development, the two outer sections are formed as a hollow shaft, and the middle section lying between them is formed as a hollow shaft. It is also advantageous if the sections which consist of different materials are interconnected by means of a flanged connection. This can be helpful during inspection operations since the different sections can be easily separated from each other.

It is also advantageous if the inflow line and the outflow line are integrated in the flanged connection.

The sections which consist of different materials are expediently welded to each other by means of at least one welded seam.

It is very advantageous if the inflow line and the outflow line are integrated in the Hirth toothing. In this case, the Hirth toothing, which can have trapezoidal, rectangular or triangular serrations, can be manufactured with a recess which is formed as an inflow and/or outflow line. As a result of this, a very simple way is provided of forming an inflow and/or outflow line. For example, the recess can be formed in the trapezoidal, rectangular or triangular serrations with adjustment in dependence upon the calculated passage volume of the cooling steam. The manufacture of such recesses on a Hirth toothing is comparatively simple and, moreover, can be quickly carried out. Cost advantages result from this.

The return line is advantageously arranged inside the outer casing. The return line can also be formed as a bore in the inner casing.

Exemplary embodiments of the invention are explained in more detail with reference to the subsequent drawings. In this case, components with the same designations have the same principle of operation.

DETAILED DESCRIPTION OF INVENTION

Figure 1:
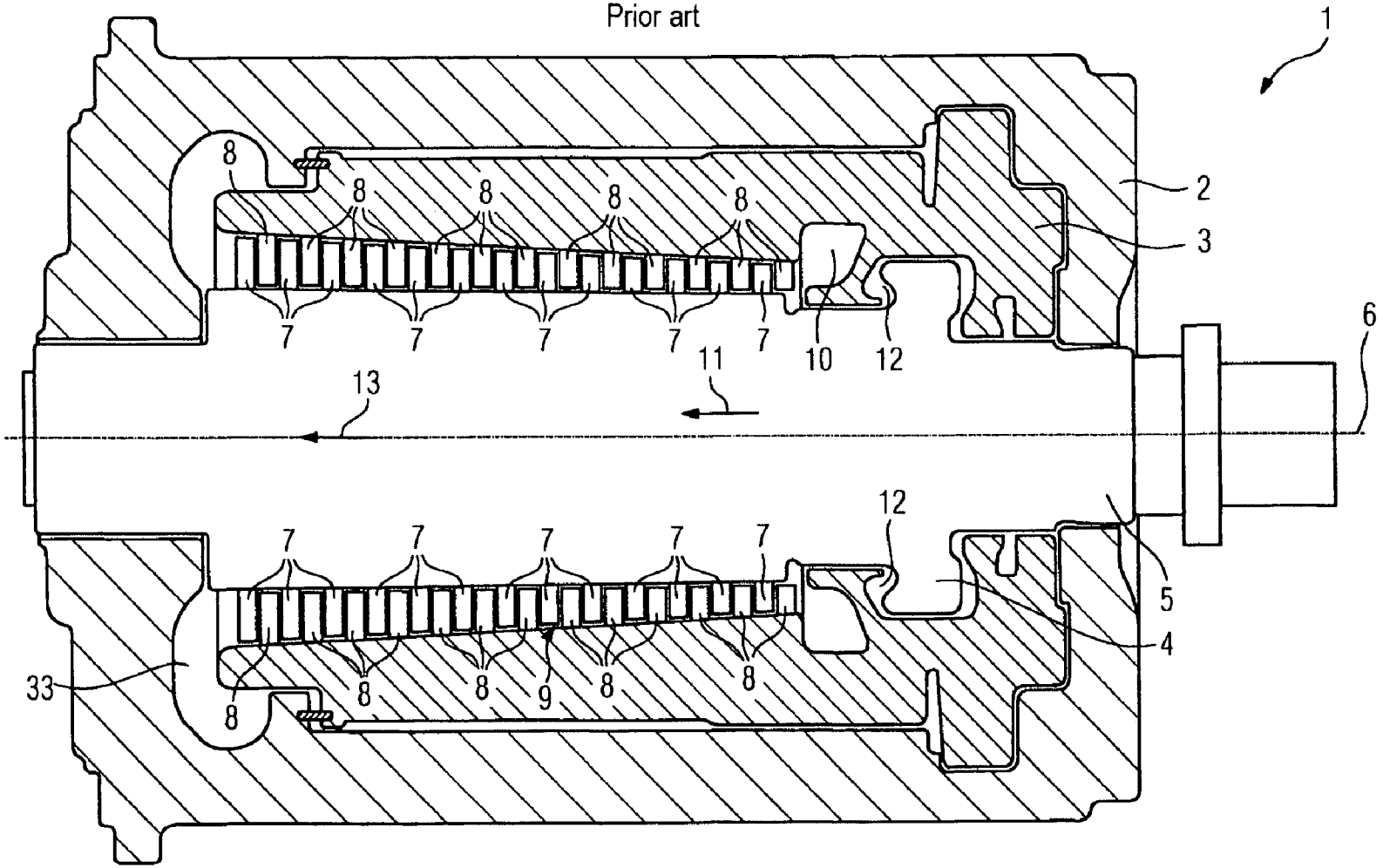
FIG 1 Prior art
FIG. 1 shows a cross-sectional view of a high-pressure turbine section according to the prior art.

In FIG. 1, a section through a high-pressure turbine section 1 according to the prior art is shown. The high-pressure turbine section 1, as an embodiment of a steam turbine, comprises an outer casing 2 and an inner casing 3 which is arranged therein. Inside the inner casing 3, a turbine shaft 5 is rotatably mounted around a rotational axis 6. The turbine shaft 5 comprises rotor blades 7 which are arranged in slots on a surface of the turbine shaft 5. The inner casing 3 has stator blades 8 which are arranged in slots on its inner surface. The stator blades 8 and rotor blades 7 are arranged in such a way that a flow passage 9 is formed in a flow direction 13. The high-pressure turbine section 1 has an inlet region 10 through which live steam flows into the high-pressure turbine section 1 during operation. The live steam can have steam parameters of over 300 bar and over 620° C. The live steam, which expands in the flow direction 13, flows in turn past the stator blades 8 and rotor blades 7, expands, and cools down. During this, the steam loses an inner energy which is converted into rotational energy of the turbine shaft 5. The rotation of the turbine shaft 5 ultimately drives a generator, which is not shown, for electric power supply. The high-pressure turbine section 1 can naturally drive other installation components apart from a generator, for example a compressor, a ship's screw or suchlike. The steam flows through the flow passage 9 and flows out of the high-pressure turbine section 1 from the exhaust 33. In doing so, the steam exerts an action force 11 in the flow direction 13. The result is that the turbine shaft 4 would execute a movement in the flow direction 13. An actual movement of the turbine shaft 5 is prevented due to the forming of a compensating piston 4. This takes place by steam with corresponding pressure being admitted in a compensating piston pre-chamber 12, which, as a result of the pressure which builds up in the compensating piston pre-chamber 12, leads to a force being created opposite the flow direction 13, which ideally should be as large as the action force 11. The steam which is admitted in the compensating piston pre-chamber 12 as a rule is tapped-off live steam which has very high temperature parameters. Consequently, the inlet region 10 and compensating piston 4 of the turbine shaft are thermally highly stressed.

Figure 2:
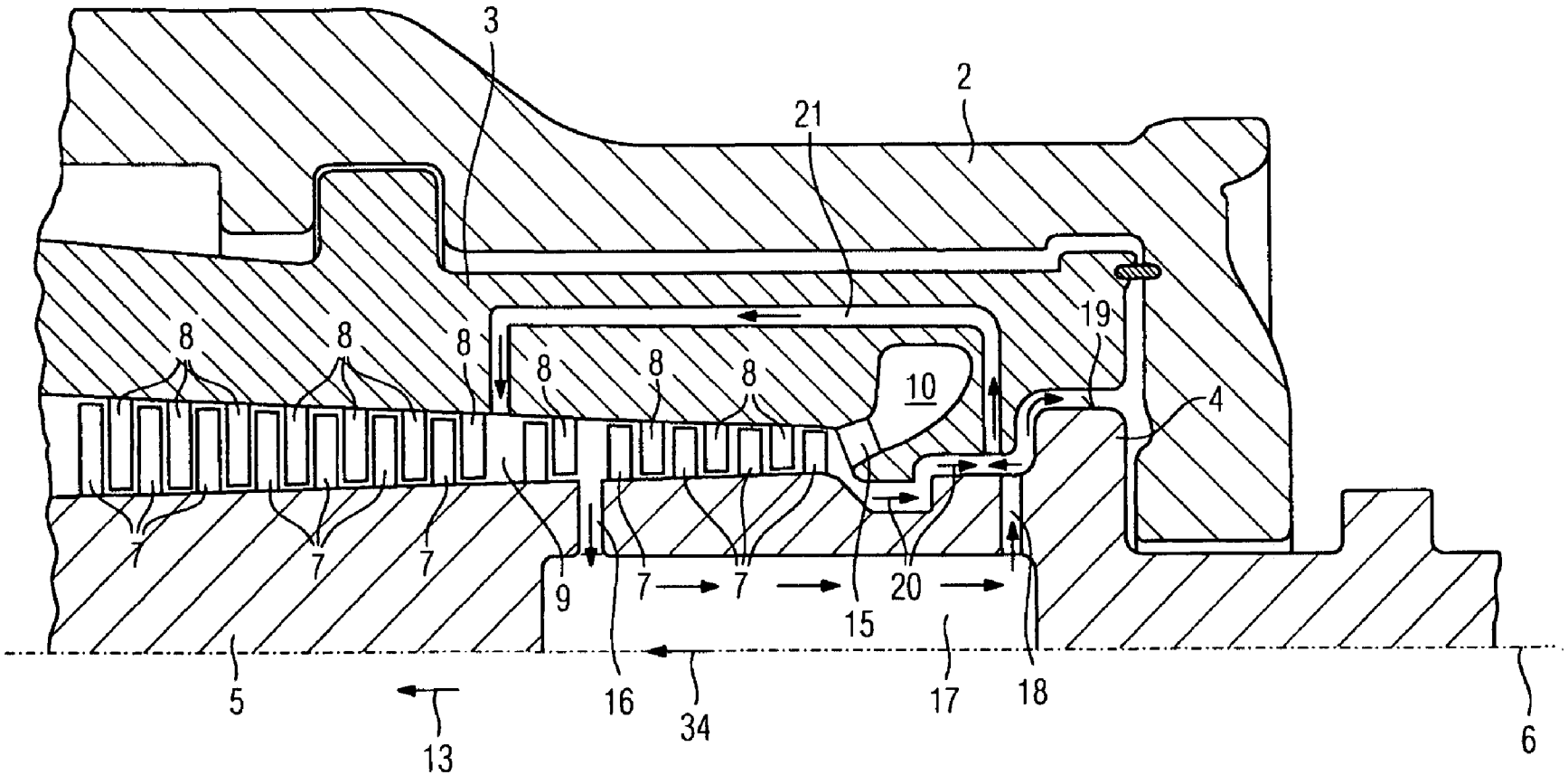
FIG. 2 shows a section through a part of a turbine section.

In FIG. 2, a detail of a steam turbine 1 is shown. The steam turbine has an outer casing 2, an inner casing 3 and a turbine shaft 5. The steam turbine 1 has rotor blades 7 and stator blades 8. Live steam reaches the flow passage 9 via the inlet region 10 via a diagonal stage 15. The steam expands and cools down in the process. The inner energy of the steam is converted into rotational energy of the turbine shaft 5.

The steam, after a defined number of turbine stages which are formed from stator blades 8 and rotor blades 7, is fluidically communicated via an inflow line 16 to a cooling air line 17. The cooling air line 17 in this case is formed as a cavity inside the turbine shaft 5. Other embodiments are conceivable. So, for example, instead of a cavity 17, it is possible to form a line, which is not shown, inside the turbine shaft 5.

The turbine shaft 5 is arranged in a rotatably mounted manner inside the casing 2, 3 and is oriented along a rotational axis 6. A flow passage 9 is formed between the casing 2, 3 and the turbine shaft 5. The cooling line 17 in this case is formed for guiding cooling steam in the direction of the rotational axis 6. The cooling line 17 is fluidically connected on one side to at least one inflow line 16. The inflow line 16 is formed for the inflow of cooling steam from the flow passage 9 into the cooling line 17.

The inflow line 16 in this case can be oriented radially to the rotational axis 6. Other embodiments of the inflow line 16 are conceivable. So, for example, the inflow line 16 can be formed at an angle perpendicularly to the rotational axis 6. The cooling line 16 could extend spirally from the flow passage 9 to the cooling line 17. The cross section of the cooling line 16 from the flow passage 9 to the cooling line 17 can vary.

The cooling line 17 is connected on the other side to at least one outflow line 18 for guiding cooling steam onto a generated surface 19 of the thrust compensating piston.

The cooling steam which flows out of the outflow line 18 is distributed to the generated surface 19 of the thrust compensating piston and cools this down in the process.

The casing 2, 3 comprises an inner casing 3 and an outer casing 2. The cooling steam which flows out of the outflow line 18 flows in two directions. On the one hand it flows in the direction of the main flow direction 13, and on the other hand flows in a direction opposite the main flow direction 13. Via the inlet region 10, some of the live steam flows between the inner casing 3 and the turbine shaft 5 in the direction of the thrust compensating piston 4. This so-called piston leakage steam 20 mixes with the cooling steam which flows out of the outflow line and is returned to the flow passage 9 by means of a return line 21. For practical reasons, this return line 21 starts between the inlet 10 and the outlet of the outflow line 18. As a result, a partial flow of the cooling steam can be directed in the direction of the main flow 13 and can block the piston leakage steam 20. In this way, the cooling of the piston surface 18, which is described above, is ensured. This mixed steam, which is formed from cooling steam and compensating piston leakage steam, is admitted at a suitable point in the flow passage 9 in order to perform work there.

The return line 21 can be formed as an external line inside the outer casing 2. The return line 21 can also be formed as a bore inside the inner casing 3.

Figure 3:
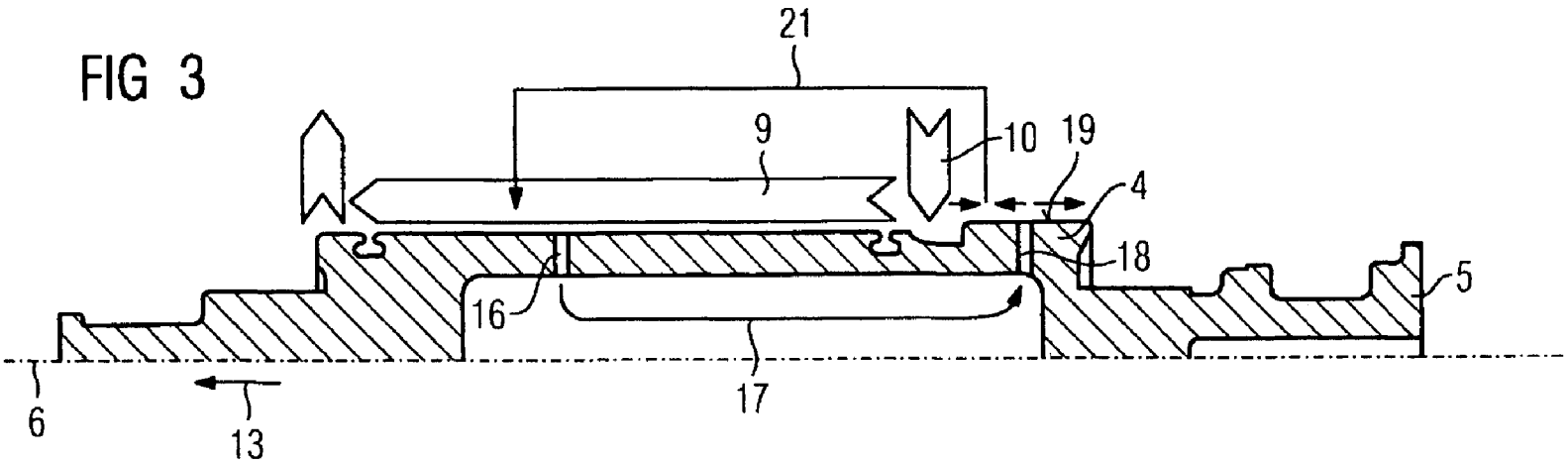
FIG. 3 shows a section through a turbine shaft.

In FIG. 3, a turbine shaft 5 is shown. The turbine shaft 5 is manufactured from a material which takes into account the thermal stresses. In this case, however, it is disadvantageous that the thermal stress is not evenly distributed on the turbine shaft 5 but, as shown earlier, is especially high in the region of the inlet 10 and of the compensating piston 4. For clarity, the rotor blades 7 are not shown.

By means of the hatching in FIG. 3, it is made clear that the turbine shaft 5 is formed from one material.

Figure 4:
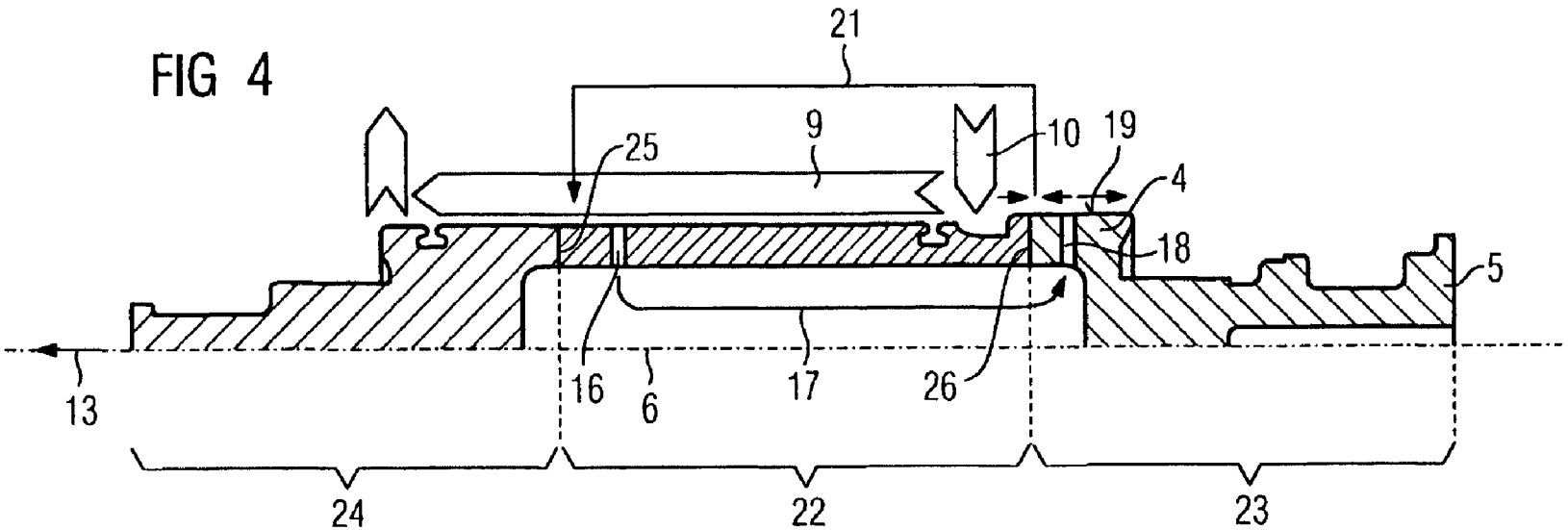
FIG. 4 shows a section through a turbine shaft in an alternative embodiment.

In FIG. 4, a further turbine shaft 5 is shown, wherein this turbine shaft 5 has at least two sections of different materials in the flow direction 13. In alternative embodiments, the turbine shaft 5 can have three sections 24, 23, 22 consisting of different materials in the axial flow direction 13. The middle section 22, for example, can be of a temperature-resistant 10% chromium steel, and the two outer sections 23 and 24 can consist of the same material, such as 1% chromium steel. In the embodiment which is shown in FIG. 4, the middle section 22 and the two outer sections 23, 24 are interconnected by means of welded connections 25 and 26.

The turbine shaft 5 can be constructed as a hollow shaft in the middle section 22, and constructed as a solid shaft in its outer sections 23, 24.

If the sections 22, 23, 24 are welded to each other, at least one welded seam is used.

The sections 22, 23, 24 of the turbine shaft 5, which consist of different materials, can be interconnected by means of a flanged connection 40, wherein the inflow line 16 and the outflow line 18 are integrated in the flanged connection.

Figure 5:
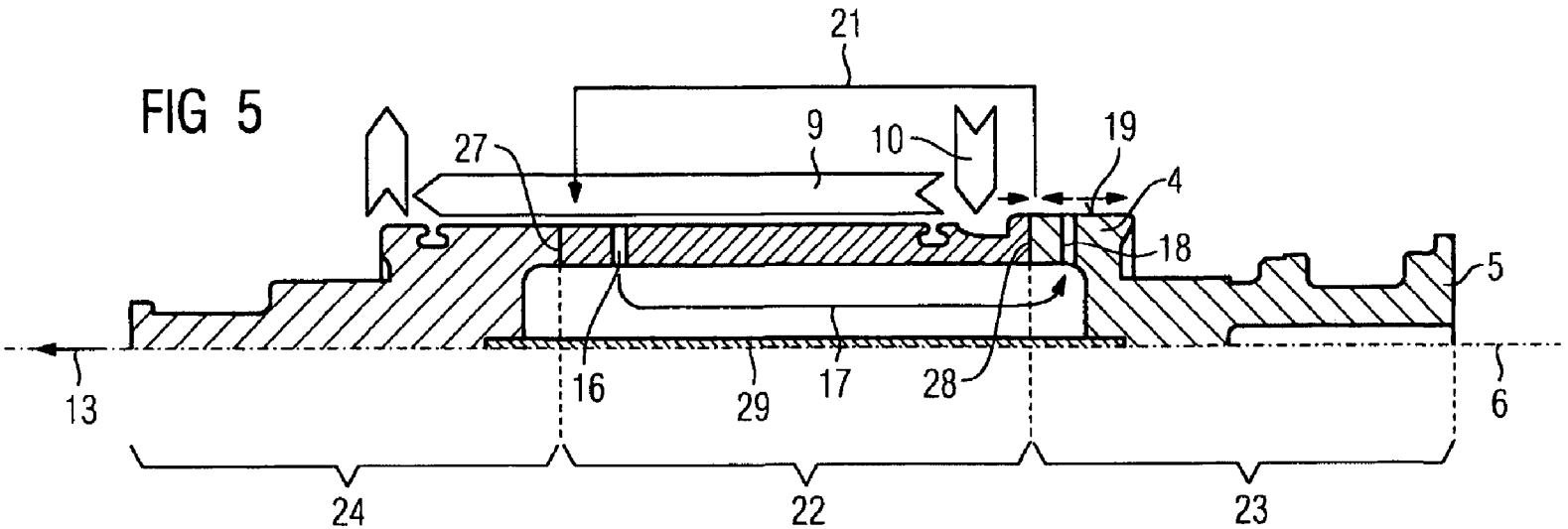
FIG. 5 shows a section through a turbine shaft in an alternative embodiment.

In FIG. 5, an alternative embodiment of the turbine shaft 5 is shown. The difference to the turbine shaft which is shown in FIG. 4 is that of the turbine shaft 5 which is shown in FIG. 5 being assembled by means of a Hirth toothing 27, 28. In this case, a tie-bolt 29 has to be formed, which is arranged in such a way that the two outer sections 23 and 24 are pressed against the middle section 22. The middle section 22 comprises one or more sections which are formed in a tubular or disk-like configuration and can include one or more rotor blade stages in each case.

Figure 6:
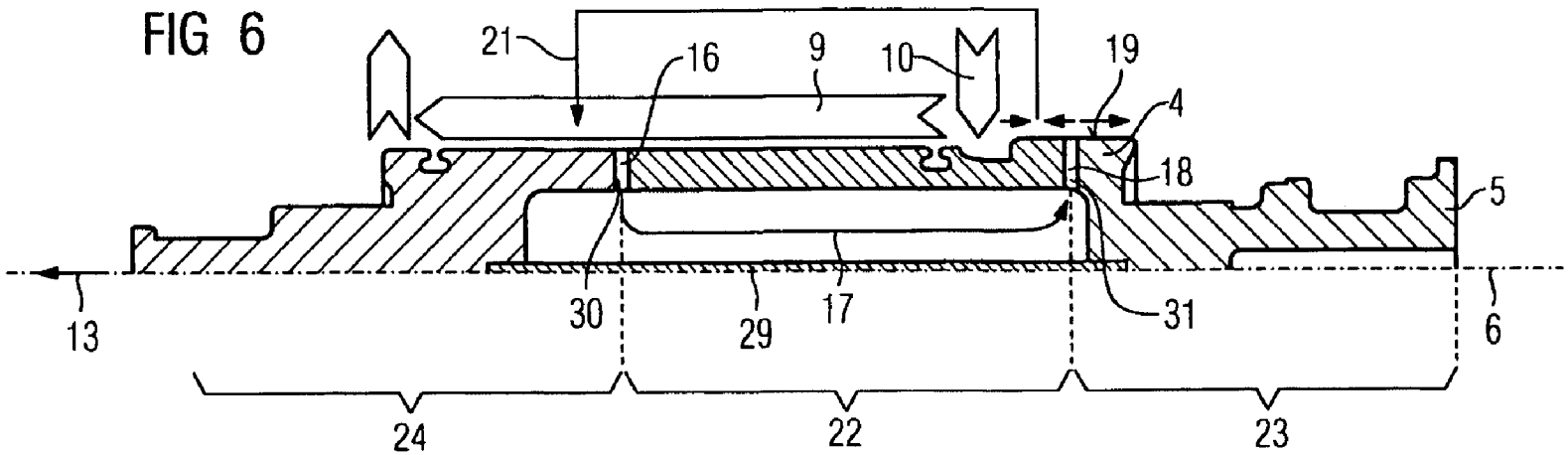
FIG. 6 shows a section through a turbine shaft in an alternative embodiment.

In a further alternative embodiment, as shown in FIG. 6, the sections 22, 23, 24 of the turbine shaft 5 are interconnected by means of a Hirth toothing 30, 31, wherein the inflow line 16 and the outflow line 18 are integrated in the Hirth toothing 30, 31.

Figure 7:
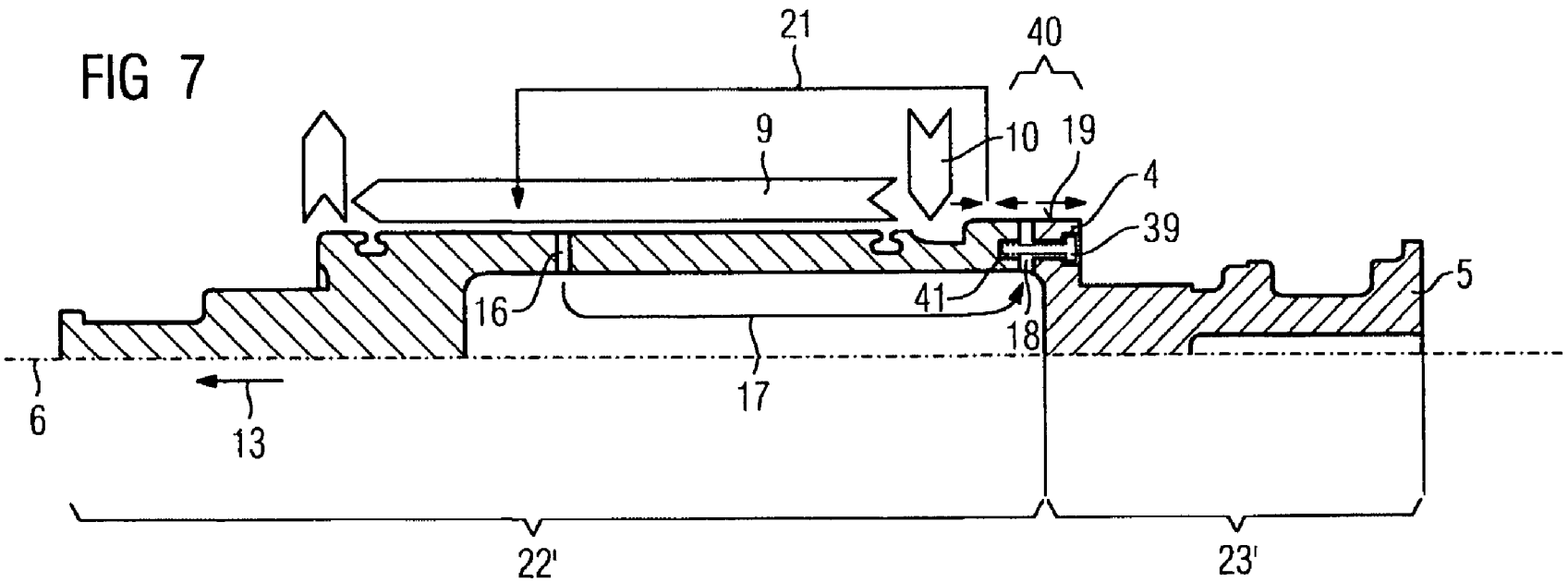
FIG. 7 shows a section through a turbine shaft in an alternative embodiment.

In FIG. 7, a further alternative embodiment of the turbine shaft 5 is shown. The turbine shaft 5 comprises at least two sections 22' and 23' which are formed from different materials. The section 23' is flanged to the section 22'. The screw fastening is carried out by means of suitable necked-down bolts 39. The flanged connection 40 is centered according to the prior art. A thread 41 for receiving the bolt 39 is expediently formed in the section 22'. Furthermore, the screw fastening of the section 23' to the section 22' is carried out preferably from the cooler side.

Figure 8:
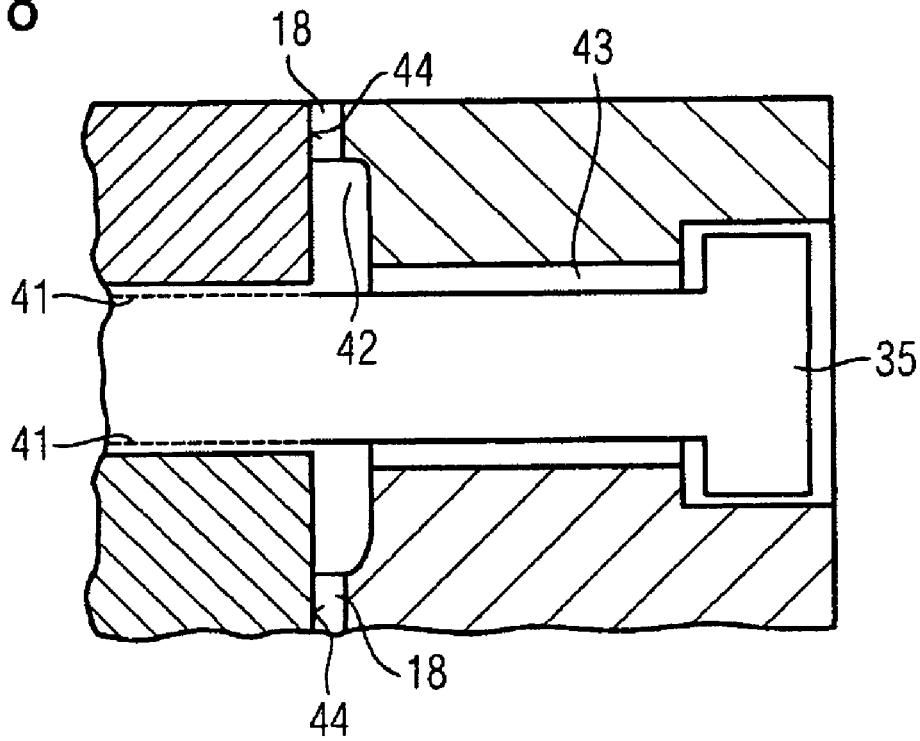
FIG. 8 shows an enlarged view of a flanged connection.
Figure 9:
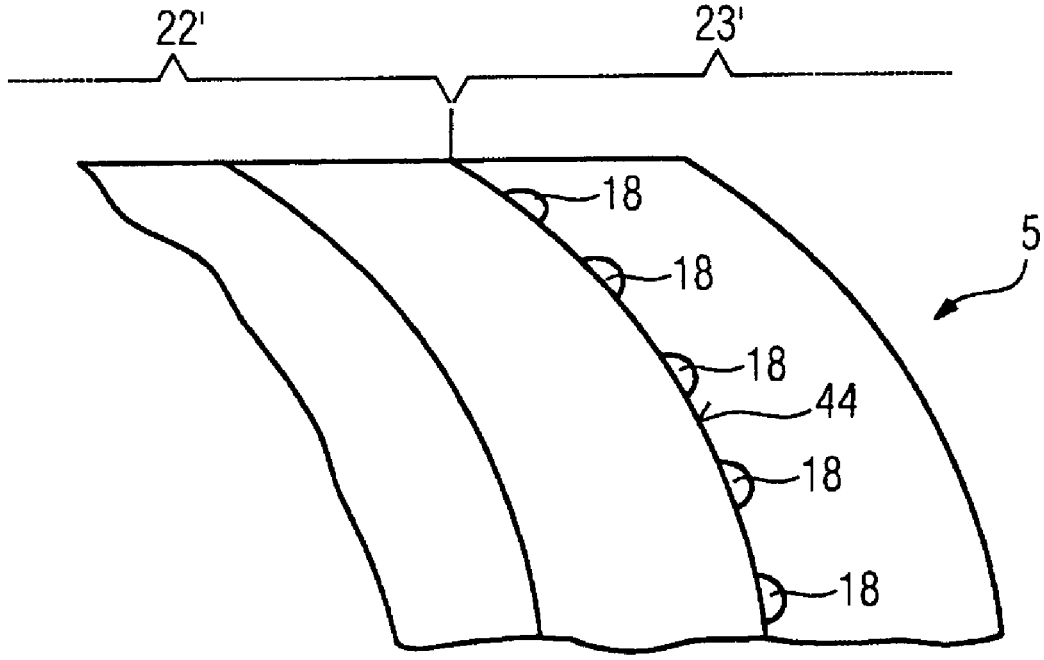
FIG. 9 shows a perspective view of a part of the flanged connection.

In FIG. 8, a sectional view of the screwed connection from FIG. 7 is to be seen. Also to be seen in this view is that the outflow line 18 is integrated in the connection by means of recesses. This is shown in a perspective view of a part of the turbine shaft 5 in FIG. 5. As a result of a connection of the outflow line 18 to the bolt-hole 43 by means of an annular space 42, cooling of the bolts can be realized and also equalization of the temperatures of the flange (compensating piston) with the bolts.

Figure 10:
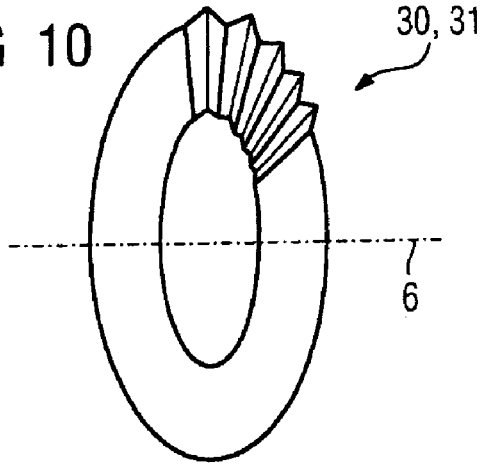
FIG. 10 shows a perspective view of the principle of a Hirth toothing.

In FIG. 10, a perspective view of a Hirth toothing 30, 31 is to be seen. The middle section 2 in this case has a Hirth toothing 30, 31 which is shown in FIG. 10. In the same way, the two outer sections 24 and 23, which consist of different materials, similarly have a Hirth toothing 30, 31.

Figure 11:
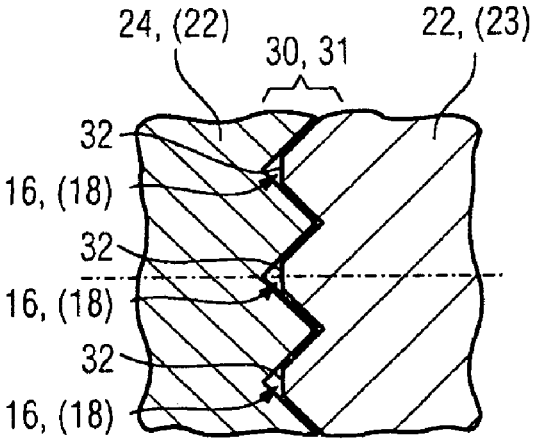
FIG. 11 shows a sectional view of a Hirth toothing with through-passages in triangular form.

In FIG. 11, a cross-sectional view of the Hirth toothing 30, 31 is to be seen. The left-hand part for example is the left-hand section 24, and the right-hand part is the middle section 22, which are interconnected via the Hirth toothing 30. The inflow line 16 is integrated in the Hirth toothing. The cross-sectional illustration which is shown in FIG. 11 can also show the outflow line 18. In this case, the left-hand part would be the middle section 22, and the right-hand part would be the right-hand section 23 which is connected via the Hirth toothing 31. The outflow line 18 is integrated in the Hirth toothing 30, 31. The embodiment which is shown in FIG. 11 has triangular serrations.

The inflow line 16 or the outflow line 18 is formed via recesses 32 of the Hirth toothing 30, 31.

Figure 12:
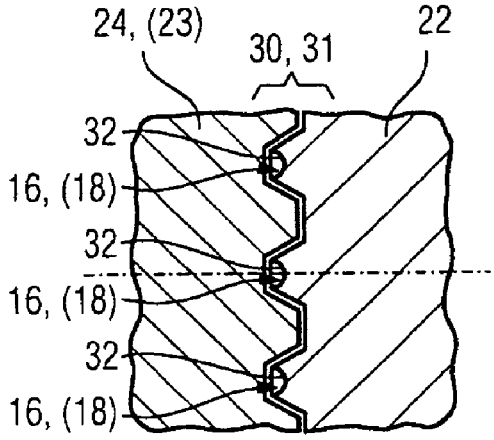
FIG. 12 shows a sectional view through a Hirth toothing in trapezoidal form with through-holes.

In the embodiment of the Hirth toothing 30, 31 which is shown in FIG. 12, this has trapezoidal serrations. Trapezoidal, rectangular or triangular serrations are possible embodiments of the Hirth toothing. Other embodiments are possible.

Figure 13:
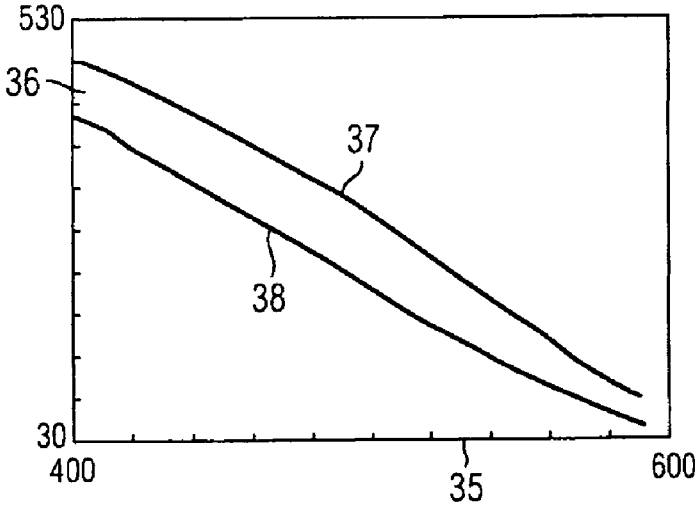
FIG. 13 shows a graph with representation of the relative creep rupture strength in dependence upon the temperature.

In FIG. 13, the relevant strength values for 1% and 10% chromium steels for steam turbine shafts are shown.

The temperature in a linear scale of 400 to 600° C. is plotted on the x-axis 35. The creep rupture strength $R_{m,200000h}$ in a linear scale of 30 to 530

$$\frac{N}{mm^2}$$

is plotted on the y-axis 36. The top curve 37 shows the temperature characteristic for the material 30 CrMoNiV5-11, and the bottom curve 38 shows the temperature characteristic for the material X12CrMoWVNbN10-1-1.

It has been shown that in addition to the guiding of cooling steam according to the invention, application of a thermal barrier coating to the surfaces of the thermally stressed components increases the efficiency of the effective cooling.

By the use of the tie-bolt 29, some of the axial forces are absorbed. As a result of this, the turbine shaft 5 can be formed with thin walls, which has a positive effect upon the thermal flexibility and upon the formation of the radial clearances.

The invention is not limited to the formation of a high-pressure turbine section as an embodiment of a steam turbine 1, the turbine shaft 5 according to the invention can also be used in an intermediate-pressure or a compact-turbine section (high-pressure and intermediate-pressure inside a casing). The turbine shaft 5 can also be used in other types of steam turbine.

The invention claimed is:

1. A steam turbine with a casing, comprising:

a rotatably mounted turbine shaft arranged inside the casing and along a rotational axis of the turbine, the turbine shaft having a thrust compensating piston, wherein a flow passage is formed between the casing and the turbine shaft;

a cooling line arranged within the rotor shaft that guides cooling steam in the direction of the rotational axis;

an inflow line connected to the cooling line on one side, that admits an inflow of cooling steam from the flow passage into the cooling line;

an outflow line connected to the other side of the cooling line, that guides cooling steam onto a generated surface of the thrust compensating piston; and a return line arranged within the casing that returns a mixture of steam to the flow passage, wherein the steam mixture is formed from cooling steam which flows out of the outflow line, and a portion of a compensating piston leakage steam that flows between the casing and the turbine shaft in the direction of the thrust compensating piston.

2. The steam turbine as claimed in claim 1, wherein the casing comprises an inner casing and an outer casing.

3. The steam turbine as claimed in claim 1, wherein the turbine shaft in the axial direction has a plurality of sections consisting of different materials.

4. The steam turbine as claimed in claim 1, wherein the turbine shaft in the axial direction has three sections consisting of different materials.

5. The steam turbine as claimed in claim 4, wherein the two rotor outer sections consist of the same material.

6. The steam turbine as claimed in claim 3, wherein the sections consisting of different materials are welded to each other.

7. The steam turbine as claimed in claim 3, wherein a first section of the plurality of sections is formed as a solid shaft and a second section of the plurality of sections is formed as a hollow shaft.

8. The steam turbine as claimed in claim 3, wherein the sections consisting of different materials are interconnected by a Hirth toothing.

9. The steam turbine as claimed in claim 3, wherein the sections consisting of different materials are interconnected by a flanged connection.

10. The steam turbine as claimed in claim 8 wherein the inflow line and the outflow line are integrated in the Hirth toothing.

11. The steam turbine as claimed in claim 9, wherein the inflow line and the outflow line are integrated in the flanged connection.

12. The steam turbine as claimed in claim 8, wherein the Hirth toothing has trapezoidal, rectangular or triangular serrations with a recess which is formed as an inflow line and/or outflow line.

13. The steam turbine as claimed in claim 12, wherein the return line is arranged inside the outer casing.

14. The steam turbine as claimed in claim 13, wherein the return line is formed as a bore in the inner casing.

* * * * *